US006173808B1

(12) United States Patent
Maeda et al.

(10) Patent No.: US 6,173,808 B1
(45) Date of Patent: Jan. 16, 2001

(54) AUTOMOBILE EXHAUST NOISE SILENCER

(75) Inventors: Kazushige Maeda, Yokohama; Akira Sasaki; Takao Kubozuka, both of Yokosuka; Haruki Yashiro, Yokohama, all of (JP)

(73) Assignee: Nissan Motor Co., Ltd., Yokohama (JP)

( * ) Notice: Under 35 U.S.C. 154(b), the term of this patent shall be extended for 0 days.

(21) Appl. No.: 08/857,071

(22) Filed: May 15, 1997

(30) Foreign Application Priority Data

May 16, 1996 (JP) ..... 8-121703
Dec. 19, 1996 (JP) ..... 8-340043

(51) Int. Cl.[7] ..... F01N 1/00
(52) U.S. Cl. ..... 181/254; 181/265; 181/272
(58) Field of Search ..... 181/237, 254, 181/264, 265, 268, 269, 272, 273, 276, 250

(56) References Cited

U.S. PATENT DOCUMENTS 4,971,166 * 11/1990 Hase ..... 181/254
5,708,237 * 1/1998 Meada et al. ..... 181/254
5,984,045 * 11/1999 Meada et al. ..... 181/254

FOREIGN PATENT DOCUMENTS 5-202729 8/1993 (JP) .

* cited by examiner

*Primary Examiner*—Khanh Dang
(74) *Attorney, Agent, or Firm*—Foley & Lardner

(57) ABSTRACT

An expansion chamber, and first and second volume chambers on either side of said expansion chamber, are formed inside a muffler housing. Engine exhaust is led by an inlet tube to the first volume chamber, and an opening facing the expansion chamber is formed in an intermediate part of the inlet tube. Exhaust in the second volume chamber is discharged outside by a tail tube, and an opening is formed facing the expansion chamber in an intermediate part of the tail tube. A valve is provided for leading exhaust from the first volume chamber to the second volume chamber according to a pressure difference between the chambers. This forms two exhaust flowpaths. A resonance system with two degrees of freedom is thereby formed with respect to exhaust discharged via the two openings and the expansion chamber, and a high noise silencing efficiency is obtained.

6 Claims, 6 Drawing Sheets

AUTOMOBILE EXHAUST NOISE SILENCER

FIELD OF THE INVENTION

This invention relates to an exhaust noise silencer for use in an automobile.

BACKGROUND OF THE INVENTION

An engine exhaust noise silencer for use in an automobile, wherein a valve which responds to the exhaust pressure is provided to change the exhaust flowpath, is disclosed for example in Tokkai Hei 5-202729.

In this device, the interior of a muffler is divided into a second expansion chamber, first expansion chamber and volume chamber in order of proximity to an exhaust manifold of the engine.

One end of an inlet tube opens out into the volume chamber, and connects with the first expansion chamber via a porous portion provided in a middle section. The first expansion chamber is connected with the second expansion chamber via a first internal tube, and the second expansion chamber is connected with the atmosphere via a tail tube. In addition, the volume chamber and second expansion chamber are connected via a second internal tube which passes through the first expansion chamber, and a valve which responds to the pressure in the volume chamber is provided at the outlet of the second internal tube.

When the valve is closed, exhaust which has flowed into the first expansion chamber from the porous portion of the inlet tube passes through the internal tubes and second expansion chamber to be discharged from the tail tube into the atmosphere. This flowpath is referred to as a first exhaust flowpath.

The downstream part of the inlet tube, the volume chamber and the second internal tube, in which exhaust does not pass when the valve is closed, form a resonance system which dampens the noise of this first exhaust flowpath.

On the other hand when the exhaust pressure in the volume chamber increases due to increase of the exhaust flowrate, the valve is open, and a part of the exhaust in the inlet tube takes a second exhaust flowpath comprising the second expansion chamber, the volume chamber and internal tube. As a result of this second exhaust flowpath, exhaust pressure losses which occur when the exhaust flowrate increases, for example at high engine speeds or under high load, are reduced. If the noises of the two exhaust flows which meet in the second expansion chamber, are arranged to have opposite phase, noise reduction can be obtained due to mutual interference in the confluence zone. This may be achieved by appropriately setting the resonant frequency of the resonance system. However in this noise silencer, as the resonance system has only one degree of freedom with respect to the first exhaust flowpath, satisfactory silencing performance cannot be obtained.

Another method to improve the silencing performance of the silencer is to decrease the diameter of the internal tubes, but in this case exhaust pressure losses increase.

Further, this silencer comprises two expansion chambers, but the volume of each chamber is lower so that silencing of low frequency noise is not very efficient.

SUMMARY OF THE INVENTION

It is therefore an object of this invention to improve the silencing performance of an automobile exhaust silencer without increasing exhaust pressure losses.

In order to achieve the above object, this invention provides a noise silencer for reducing exhaust noise of an automobile engine. The silencer comprises a housing, an expansion chamber formed in the housing, first and second volume chambers formed adjacent to the expansion chamber in the housing, an inlet tube for leading engine exhaust from outside the housing into the first volume chamber, this inlet tube having an opening facing the expansion chamber, a tail tube for discharging exhaust in the second volume chamber outside the housing, this tail tube having an opening facing the expansion chamber, and a valve for leading exhaust from the first volume chamber to the second volume chamber according to a pressure difference between the first and second volume chambers.

The details as well as other features and advantages of this invention are set forth in the remainder of the specification and are shown in the accompanying drawings.

DESCRIPTION OF THE PREFERRED EMBODIMENTS

Figure 1:
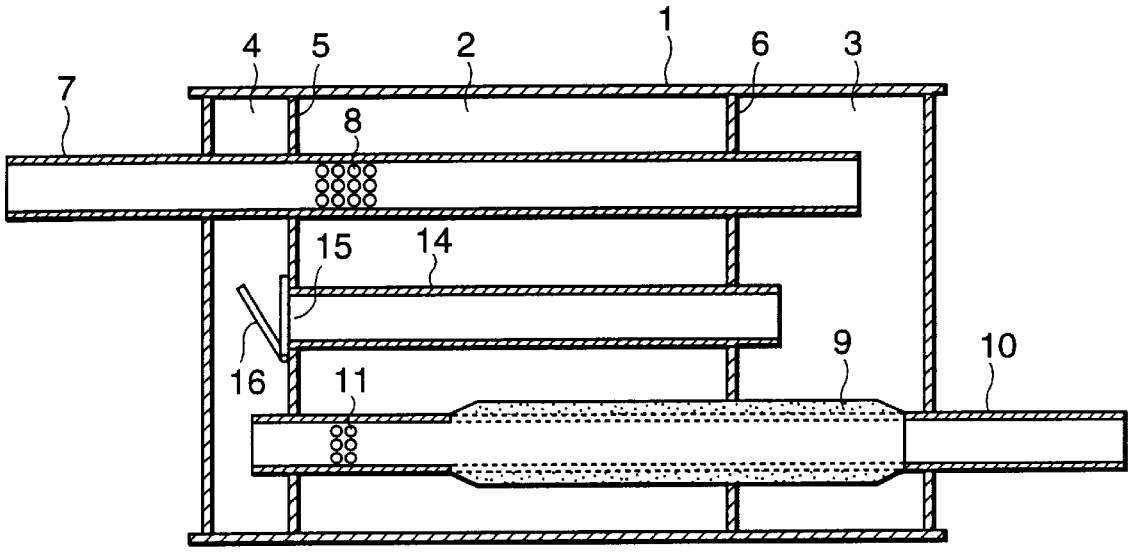
FIG. 1 is a vertical sectional view of a silencer according to a first embodiment of this invention.

Referring to FIG. 1 of the drawings, the inside of a housing 1 of a muffler is partitioned into a first volume chamber 3, expansion chamber 2 and a second volume chamber 4 by baffle plates 5 and 6. An inlet tube 7 which introduces exhaust from an engine into the muffler penetrates the second volume chamber 4 and expansion chamber 2, and opens into the interior of the first volume chamber 3. A porous portion 8 is formed in an intermediate part of the inlet tube 7. Engine exhaust led to the interior of the muffler by inlet tube 7 flows into the expansion chamber 2 through this porous portion 8.

A first volume chamber 3 connects with a second volume chamber 4 through an internal tube 14 which penetrates the expansion chamber 2. One end of the internal tube 14 has an opening into the second volume chamber 4 on the baffle plate 5.

A pressure response valve 16 is provided in this opening area. The pressure response valve 16 is pushed in the closing direction by a spring, not shown, and it is closed when exhaust pressure is low such as at low engine rotation speeds. As the engine revolution speed increases and the pressure of the first volume chamber 3 rises, the pressure response valve 16 gradually opens, and exhaust in the first volume chamber 3 flows into the second volume chamber 4.

One end of a tail tube 10 opens into the second volume chamber 4.

The tail tube 10 passes through the first volume chamber 3 and expansion chamber 2, and projects from the housing 1 in a direction opposite to that of the inlet tube 7 so as to open into the atmosphere.

A porous portion 11 which has a number of openings into the expansion chamber 2 is formed in an intermediate part of the tail tube 10. A noise damper 9 is also provided downstream of the porous portion 11 of the tail tube 10.

The noise damper 9 is formed by covering a large number of pores formed in the tail tube 10 by a noise damping material. The outer circumference of the noise damping material is covered with an outer tube to prevent exhaust from leaking from the damper 9 to the outside.

The porous portion 8 of the inlet tube 7 and porous portion 11 of the tail tube 10 are both formed in the vicinity of the second volume chamber 4 in the expansion chamber 2, and provide a large opening.

Due to this construction, when exhaust pressure is low and the pressure response valve 16 is closed, exhaust introduced into the muffler via the inlet tube 7 from the engine is discharged via a first exhaust flowpath comprising the porous portion 8, expansion chamber 2, porous portion 11 and tail tube 10.

In this case, the resonance system comprising the downstream part of the inlet tube 7, the first volume chamber 3 and the internal tube 14, and the resonance system comprising the upper part of the tail tube 10 and the second volume chamber 4, reduce the exhaust noise of the first exhaust flowpath.

When the pressure response valve 16 opens, exhaust is discharged not only via the aforesaid first exhaust flowpath but also via a second exhaust flowpath comprising the downstream part of the inlet tube 7, the first volume chamber 3, the internal tube 14, the second volume chamber 4 and the tail tube 10. In this case, two acoustic paths are formed.

In this case also, two resonance systems are formed relative to the first exhaust flowpath, i.e. the downstream part of the inlet tube 7 and the first volume chamber 3, and the upper part of the tail tube 10 and the second volume chamber 4. These resonance systems each have their own resonance frequencies, and the second exhaust flowpath functions as a resonance system with effectively two degrees of freedom relative to the first exhaust flowpath.

As the first volume chamber 3 and the second volume chamber 4 are connected via the pressure response valve 16, one of these resonance frequencies is shifted to higher frequency due to the opening of the pressure response valve 16.

When the resonance system affects the first exhaust flowpath, a peak acoustic pressure is produced due to back resonance, and a peak acoustic pressure at the same frequency as that of this back resonance occurs also in the second path. There are back resonance frequencies both before and after the resonance frequency.

In this device wherein the resonance system formed by the second exhaust flowpath relative to the first exhaust flowpath has two degrees of freedom, there are back resonance frequencies immediately above and below each of the two resonance frequencies of the second exhaust flowpath giving a total of four acoustic peaks due to back resonance. Further, the phases of the pressure waves of the first and second exhaust flowpaths differ by 180 degrees at one of the resonance frequencies, i.e. the phases are effectively reversed at this frequency.

This reverse phase continues until the next resonance frequency, and another 180 degree shift occurs at the resonance frequency after that so that the two pressure waves are again in phase. If the acoustic pressure levels of the exhaust flowing into the tail tube 10 from each exhaust flowpath are effectively equal in a confluence zone where the two pressure waves mix, and the phases of the two pressure waves are opposite as described above, the two waves will interfere to give the optimum noise silencing effect.

In this noise silencer, the acoustic pressure level of the exhaust which flowed through the second exhaust flowpath has peaks at each of the four back resonance frequencies.

In the frequency region between these peaks the acoustic pressure level remains high, and it falls off as the frequency increases beyond the peak situated at the highest frequency. Likewise, it also falls off as the frequency decreases from the peak situated at the lowest frequency.

On the other hand, the acoustic pressure level of the exhaust which flowed through the first flow path is low at the two resonance frequencies and is high between these resonance frequencies.

As described hereabove, in the confluence zone of the tail tube 10, the sound waves of the exhaust flowing in from the first exhaust flowpath and that of the exhaust flowing in from the second exhaust flowpath have opposite phase in the frequency region between the two resonance frequencies. As a result, these mutually high sound levels cancel out in the confluence zone, and an efficient noise silencing effect is achieved.

However, when the resonance system formed by the second exhaust flowpath relative to the first exhaust flowpath has only one degree of freedom, the acoustic pressure level of the second exhaust flowpath falls in the frequency regions beyond the back resonance frequencies on either side of the resonance frequency, and a substantial difference emerges from the acoustic pressure level of the first exhaust flowpath. In this case, as the acoustic pressure level of the second exhaust flowpath is low, a sufficient noise silencing effect due to mutual interference is not obtained even though the sound waves in the confluence zone of the two exhaust flowpaths have opposite phase.

In this device, when the pressure response valve 16 opens due to increase of engine rotation speed, the higher frequency of the aforesaid two resonance frequencies is shifted to still higher frequency. In other words, although exhaust noise is shifted to higher frequency as engine rotation speed increases, the noise reduction due to mutual interference of pressure waves is also shifted to higher frequency, so noise silencing characteristics which are well matched to those of the engine exhaust are obtained.

Figure 2:
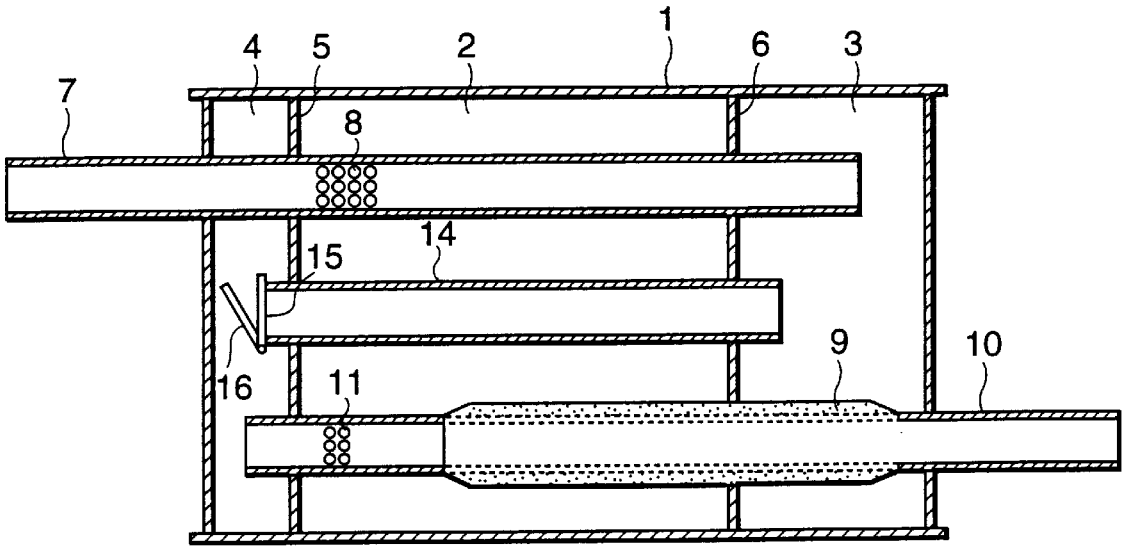
FIG. 2 is similar to FIG. 1, but showing a variation of the first embodiment relating to the attachment of a pressure response valve.

In this device, the pressure response valve 16 is fitted to a baffle plate 5, however it may also be directly attached to one end of the internal tube 14 which projects into the volume chamber 4 as shown in FIG. 2.

Figure 3:
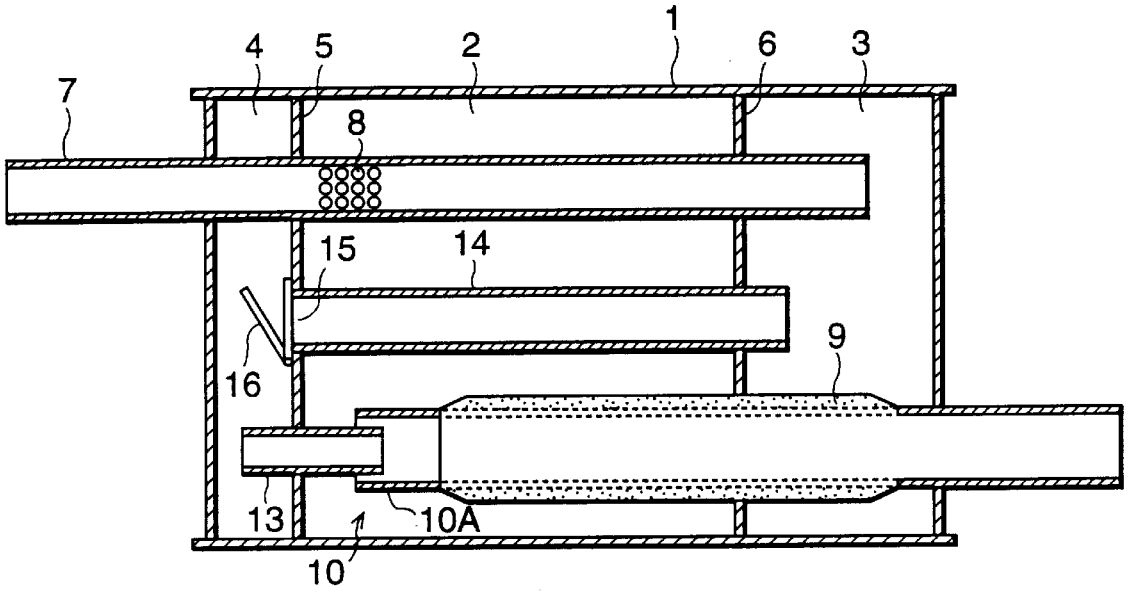
FIG. 3 is similar to FIG. 1, but showing a variation of the first embodiment relating to the construction in which exhaust flows from an expansion chamber to a tail tube.

The tail tube 10 may comprise a tail tube body 10A and neck 13 fitted to the baffle plate 5 as shown in FIG. 3.

In this case, instead of providing the porous portion 11, the neck tube 13 is inserted in the tail tube body 10A with a predetermined gap as shown in the figure. In this arrangement, the gap between the neck tube 13 and tail tube body 10A forms an opening which replaces the porous portion 11. In such a case, the diameter of the neck tube 13 and the gap between the neck tube 13 and tail tube body 10A may be freely chosen, so more freedom is possible in the setting of the resonance frequencies.

Figure 4:
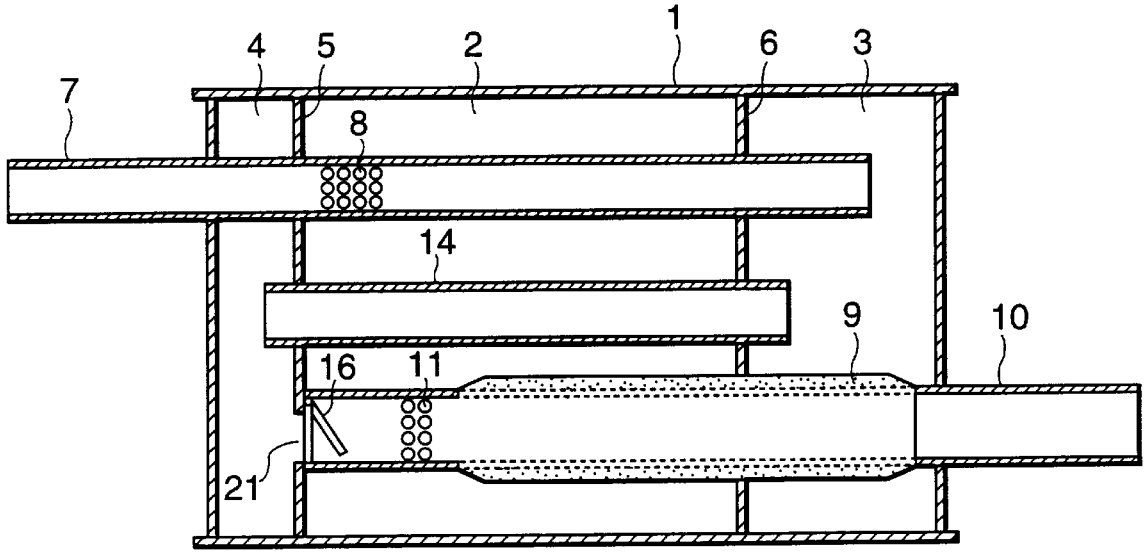
FIG. 4 is a vertical sectional view of a silencer according to a second embodiment of this invention.
Figure 5:
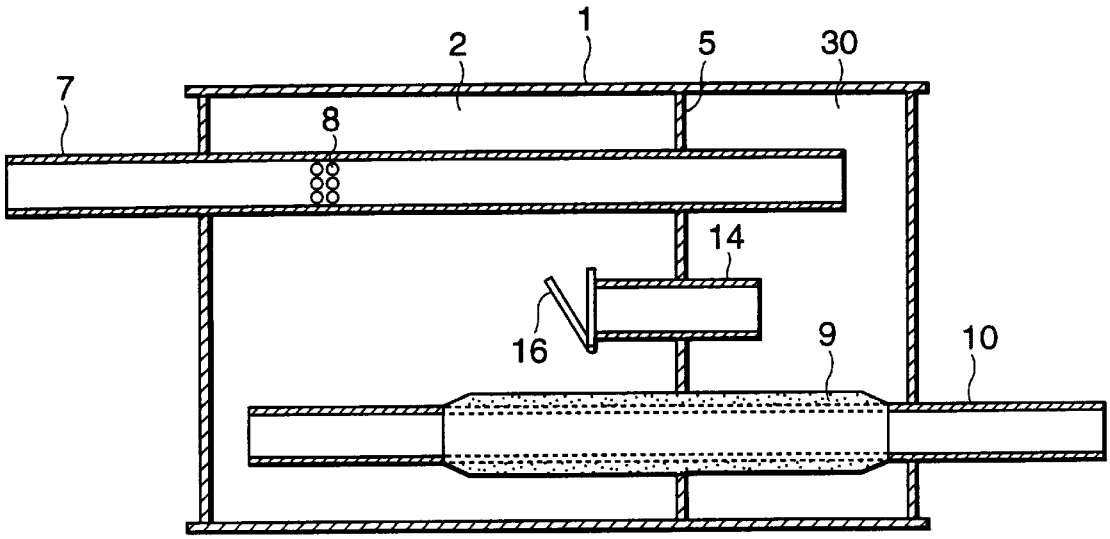
FIG. 5 is a vertical sectional view of a silencer according to a third embodiment of this invention.

FIG. 4 shows a second embodiment of this invention.

According to this embodiment, the pressure response valve 16 is provided in the upstream end 21 of the tail tube 10.

According to this embodiment, the exhaust noise resonance system of the first exhaust flowpath still has one degree of freedom as in the aforesaid prior art, however the volume of the resonance system is much greater than in the noise silencer of the prior art. The resonance frequency may therefore be set lower. Low frequency noise causes discomfort to the passengers in the vehicle, but this type of low frequency noise may thus be effectively reduced by the noise silencer according to this second embodiment without changing the overall size of the noise silencer. The upstream end of the tail tube 10 may also be made to project into the second volume chamber 4.

FIGS. 5, 6, 11 and 12 show a third embodiment of this invention.

This noise silencer has a single volume chamber 30 and expansion chamber 2. The downstream end of the inlet tube 7 opens into a volume chamber 30, and the porous portion 8 and the upstream end of the tail tube 10 open into the expansion chamber 2. The volume chamber 30 and expansion chamber 2 are connected by the internal tube 14, and the pressure response valve 16 is attached to one end of the internal tube 14 which opens into the expansion chamber 2.

The opening surface area of the porous portion 8 is set so that the pressure of the volume chamber 30 exceeds the pressure of the expansion chamber 2.

When the pressure response valve 16 is closed, exhaust led into the housing 1 by the inlet tube 7 is discharged via the porous portion 8, expansion chamber 2 and tail tube 10. The downstream part of inlet tube 7, the volume chamber 30 and the internal tube 14 act as a resonance system for exhaust noise in the first exhaust flowpath. When the pressure response valve 16 opens due to rise of exhaust pressure, part of the exhaust flows from the downstream end of the inlet tube 7 into the volume chamber 30, and is then discharged into the atmosphere via the internal tube 14, expansion chamber 2 and tail tube 10.

As this device has a single expansion chamber its construction is simple, and the expansion chamber 2 can be given ample volume. Further, the pressure applied to the pressure response valve 16 may also be adjusted by setting the area of the porous portion 8. Compared to the prior art, the noise silencing effect is therefore enhanced, there is considerable freedom of design, and manufacture is simple.

Figure 6:
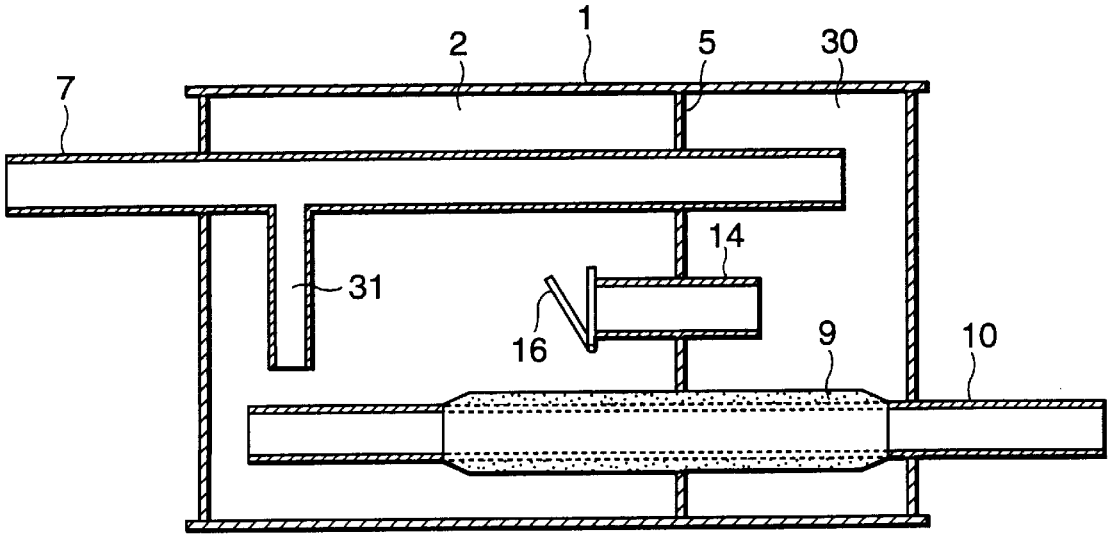
FIG. 6 is similar to FIG. 5, but showing a variation of the third embodiment relating to the construction in which exhaust flows from an inlet tube to the expansion chamber.

A branch tube 31 may be provided instead of the porous portion 8, as shown in FIG. 6.

Figure 11:
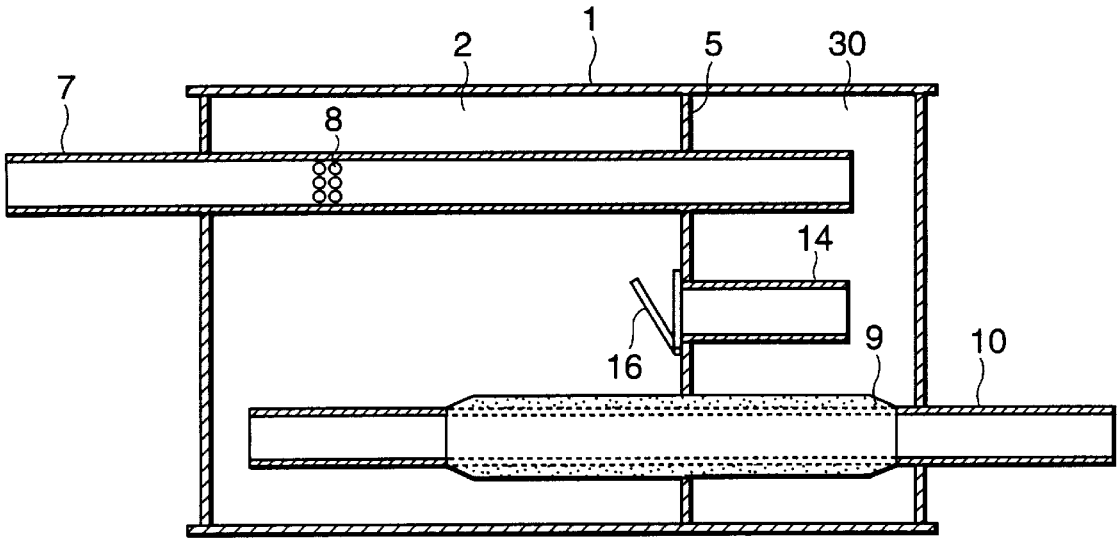
FIG. 11 is similar to FIG. 5, but showing a variation of the third embodiment relating to the position of the pressure response valve.

Instead of fitting the pressure response valve 16 to the internal tube 14, it may be attached to the baffle plate 5 as shown in FIG. 11, and the internal tube 14 made to project into the volume chamber 30.

Figure 12:
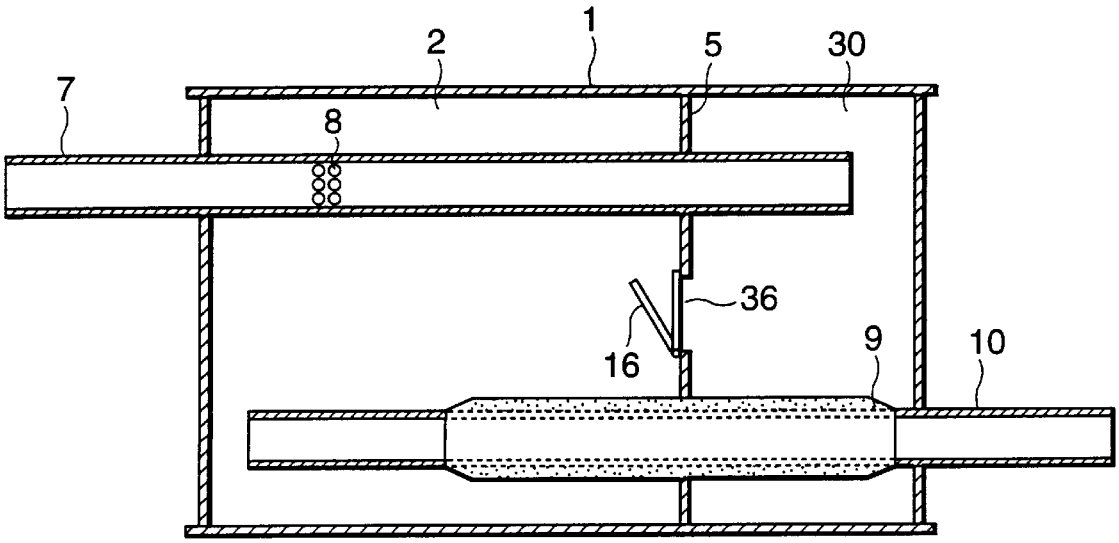
FIG. 12 is similar to FIG. 5, but showing another variation of the third embodiment relating to the attachment of the pressure response valve.

Further, as shown in FIG. 12, the internal tube 14 may be omitted which is even more economical.

Figure 7:
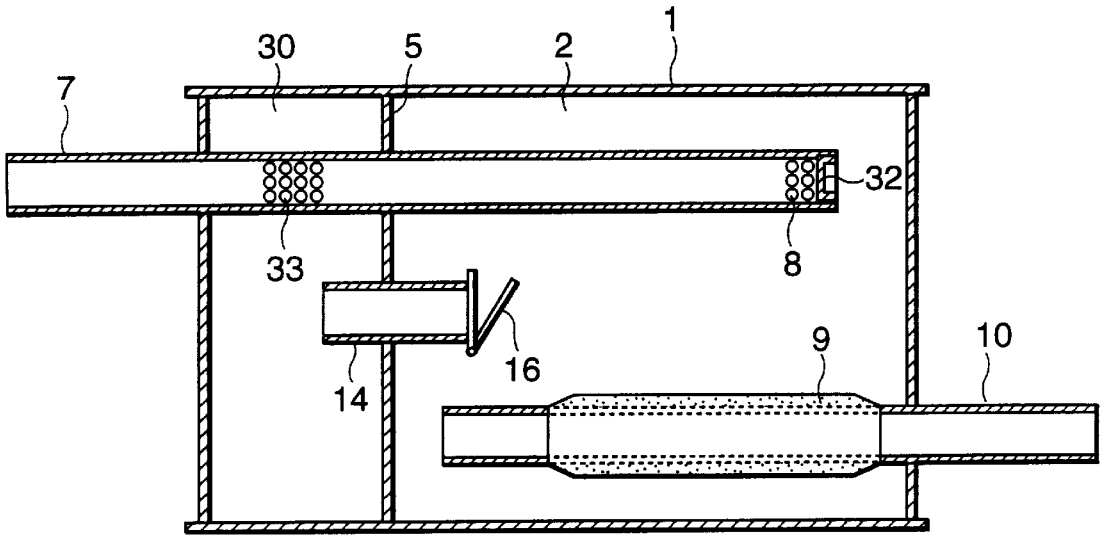
FIG. 7 is a vertical sectional view of a silencer according to a fourth embodiment of this invention.
Figure 8:
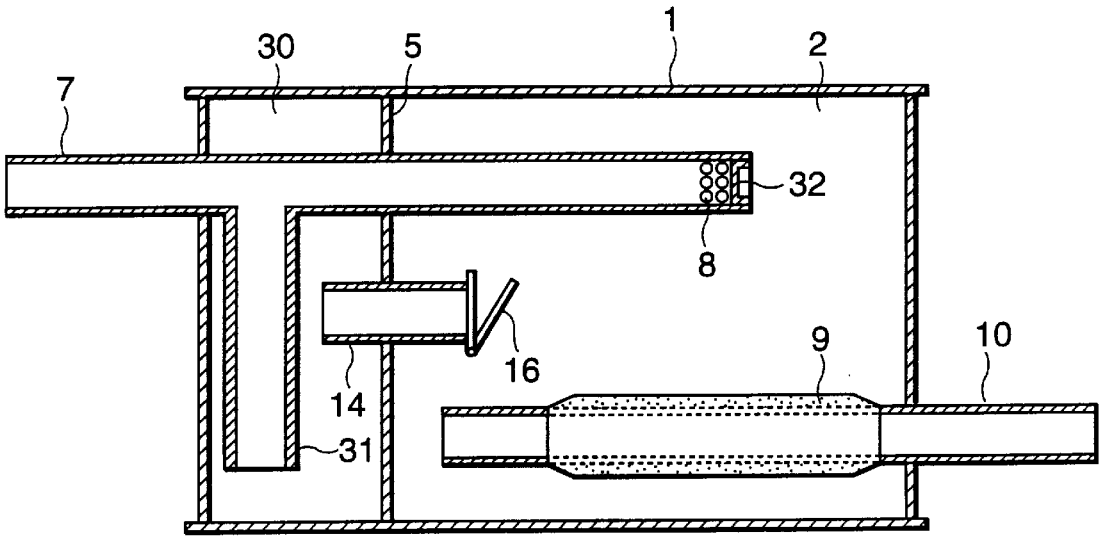
FIG. 8 is similar to FIG. 7, but showing a variation of the fourth embodiment relating to the construction in which exhaust flows from the inlet tube to a volume chamber.

FIGS. 7 and 8 show a fourth embodiment of this invention.

In this embodiment, the downstream end of the internal tube 7 is closed by a plug 32, and the porous portion 8 is formed in the vicinity of the downstream end. The positions of the expansion chamber 2 and volume chamber 30 are also reversed with respect to the aforesaid third embodiment.

A porous portion 33 which opens into the volume chamber 30 is formed midway along the inlet tube 7. The pressure response valve 16 which opens due to pressure rise in the volume chamber 30 is attached to the internal tube 14 connecting the volume chamber 30 and expansion chamber 2. The total opening surface area of the porous portion 8 is set so that the pressure in the volume chamber 30 exceeds the pressure in the expansion chamber 2.

According to this construction, the volume chamber 30 is situated upstream and the expansion chamber 2 is situated downstream with respect to the flow of exhaust in the inlet tube 7. Full advantage may therefore be taken of the noise silencing effect of the resonance system formed by the porous portion 33 and volume chamber 30.

The branch tube 31 may be provided instead of the porous portion 33 as shown in FIG. 8.

Figure 9:
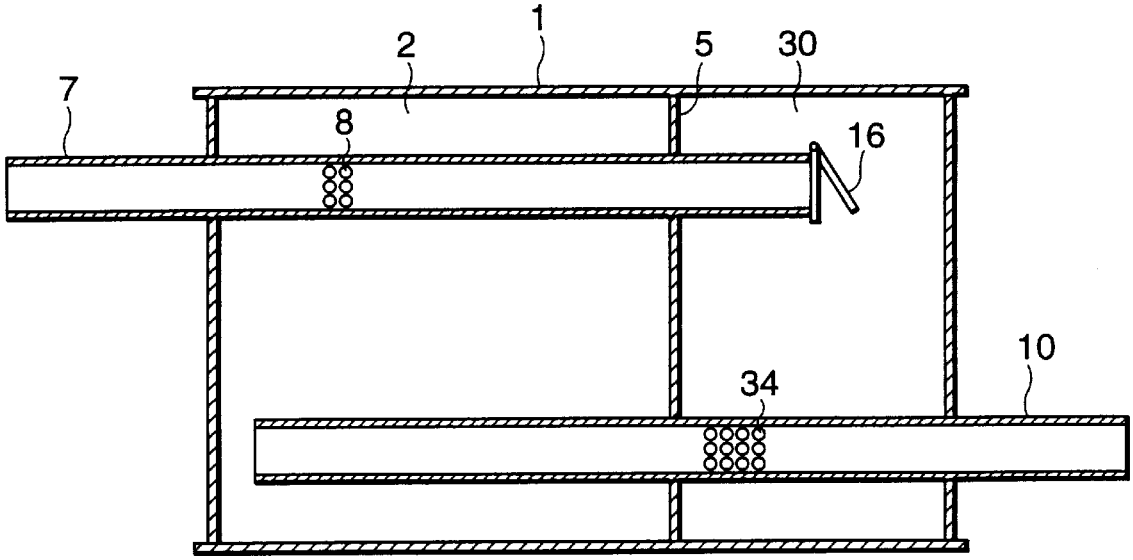
FIG. 9 is a vertical sectional view of a silencer according to a fifth embodiment of this invention.
Figure 10:
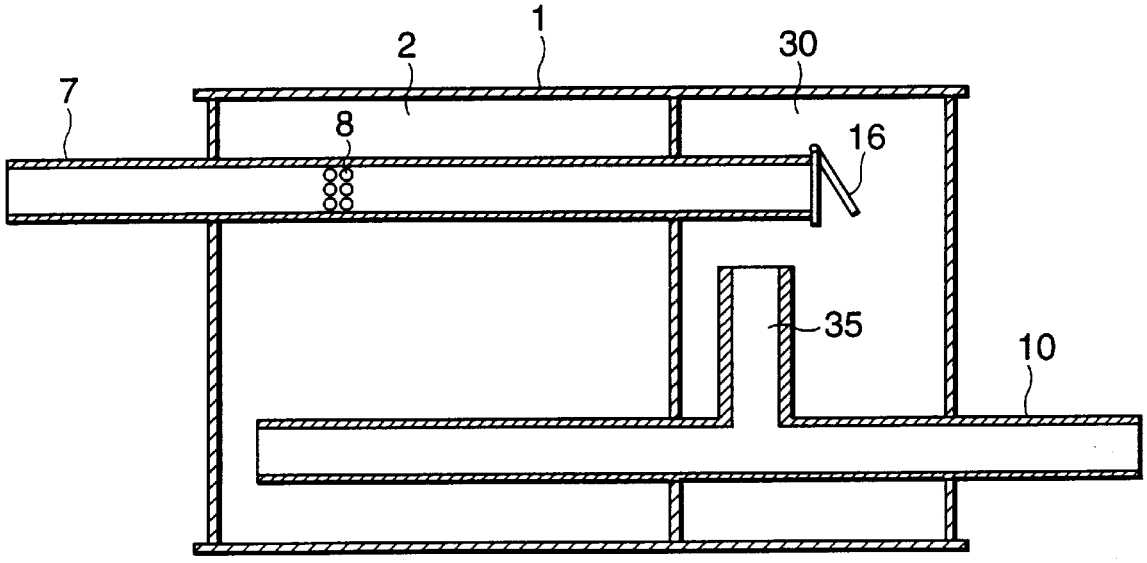
FIG. 10 is similar to FIG. 9, but showing a variation of the fifth embodiment relating to the construction in which exhaust flows from the expansion chamber to the tail tube.

FIGS. 9 and 10 show a fifth embodiment of this invention.

In this embodiment, the porous portion 8 opens into the expansion chamber 2 midway along the inlet tube 7, and the pressure response valve 16 is fitted to the downstream end of the inlet tube 7 in the volume chamber 30. The opening surface area of the porous portion 8 is set so that the internal pressure of the downstream part of the inlet tube 7 exceeds the pressure of the volume chamber 30.

The tail tube 10 opens into the expansion chamber 2, and a porous portion 34 is formed which opens into the volume chamber 30 midway along the tail tube 10.

By directly fitting the pressure response valve 16 to the downstream end of the inlet tube 7 in this way, the internal tubes are unnecessary, the expansion chamber 2 can be give ample volume and manufacturing costs can be reduced.

According to this embodiment, the branch tube 35 may be provided instead of the porous portion 34 as shown in FIG. 10.

What is claimed:

1. A noise silencer for reducing exhaust noise of an automobile engine, comprising:

a housing;

an expansion chamber formed in said housing;

first and second volume chambers formed adjacent to said expansion chamber in said housing;

an inlet tube for leading engine exhaust from outside said housing into said first volume chamber, said inlet tube having an opening that connects an interior of said inlet tube to said expansion chamber;

a tail tube for discharging exhaust in said second volume chamber outside said housing, said tail tube having an opening that connects an interior of the said tail tube to said expansion chamber;

an internal tube that connects said first and second volume chambers; and a valve operatively provided on said internal tube, the valve allowing exhaust in said first volume chamber to flow to said second volume chamber according to a pressure difference between said first and second volume chambers.

2. A noise silencer as defined in claim 1, wherein said valve is fitted to said internal tube.

3. A noise silencer as defined in claim 1, wherein said silencer further comprises a baffle plate dividing said expansion chamber and said second volume chamber, and said valve is fitted to said baffle plate.

4. A noise silencer as defined in claim 1, wherein said opening in said inlet tube comprises a porous portion formed in said inlet tube.

5. A noise silencer as defined in claim 1, wherein said opening in said tail tube comprises a porous portion formed in said tail tube.

6. A noise silencer as defined in claim 1, wherein said tail tube comprises a first pipe connecting said expansion chamber and said second volume chamber, and a second pipe of larger diameter than said first pipe such that said first pipe partially projects into said second pipe, and wherein said opening in said tail tube is formed on a portion of said first pipe that does not project into said second pipe.

* * * * *